US005429346A

United States Patent [19]

Andersson et al.

[11] Patent Number: 5,429,346

[45] Date of Patent: Jul. 4, 1995

[54] APPARATUS FOR DISCHARGING PACKAGING CONTAINER BLANKS

[75] Inventors: Roland Andersson, Arlington Heights, Ill.; Ulf Mossberg, l/o/ddeköpinge, Sweden

[73] Assignee: Tetra Laval Holdings & Finance SA, Pully, Switzerland

[21] Appl. No.: 170,878

[22] Filed: Dec. 21, 1993

[30] Foreign Application Priority Data

Dec. 22, 1992 [SE] Sweden ..... 9203879

[51] Int. Cl.[6] ..... B65H 5/68; B65H 5/12

[52] U.S. Cl. ..... 271/11; 271/104; 271/107; 221/211; 221/224; 221/259; 221/305

[58] Field of Search ..... 271/11, 103, 104, 107, 271/108; 221/259, 211, 305, 173, 218, 224, 225, 226, 230, 253

[56] References Cited

U.S. PATENT DOCUMENTS

| | | | |
|---|---|---|---|
| 1,530,387 | 3/1925 | Marra | 221/253 X |
| 1,804,612 | 5/1931 | Holversen . | |
| 2,819,073 | 1/1958 | Murray | 271/11 |
| 3,066,579 | 12/1962 | Brush | 93/53 |
| 3,147,978 | 9/1964 | Sjöstrand | 271/107 X |
| 4,129,294 | 12/1978 | Marass | 271/107 X |
| 4,346,876 | 8/1982 | Guenther et al. | 271/107 X |
| 4,369,962 | 1/1983 | Spiro | 271/11 |
| 4,394,011 | 7/1983 | Dalton | 271/107 |
| 4,402,497 | 9/1983 | Weibel et al. | 271/11 |
| 4,484,735 | 11/1984 | Goi | 271/12 |
| 4,516,763 | 5/1985 | Stahl et al. | 271/11 |
| 4,921,237 | 5/1990 | Nubson et al. | 271/11 |
| 5,050,855 | 9/1991 | Focke et al. | 271/132 |
| 5,079,903 | 1/1992 | Hakansson | 53/473 |
| 5,137,269 | 8/1992 | Yamamoto | 221/197 X |
| 5,328,164 | 7/1994 | Soga | 271/107 X |

FOREIGN PATENT DOCUMENTS

| | | | |
|---|---|---|---|
| 784463 | 4/1935 | France | 221/211 X |
| 2687652 | 8/1993 | France | 271/11 X |
| 648580 | 7/1937 | German Dem. Rep. | 271/104 X |
| 1084278 | 6/1960 | Germany . | |
| 1156014 | 10/1963 | Germany . | |
| 2837647 | 3/1979 | Germany | 271/11 X |
| 3337307 | 4/1985 | Germany . | |
| 2123556 | 8/1992 | Germany . | |
| 1019091 | 2/1966 | United Kingdom | 221/259 X |
| 2133779 | 8/1984 | United Kingdom . | |

*Primary Examiner*—David H. Bollinger
*Assistant Examiner*—Dean A. Reichard
*Attorney, Agent, or Firm*—Burns, Doane, Swecker & Mathis

[57] ABSTRACT

In terms of their operational reliability, apparatuses for discharging from a magazine of flat-laid packaging container blanks of the type used for manufacturing packaging containers for liquid contents are greatly dependent upon the quality of the packaging container blanks themselves. In the event of variations in friction or abutment pressure between the packaging container blanks, there is a risk that more than one blank is discharged at a time, or alternatively that no blank is discharged at all. In order to ensure a dependable function with repeated discharge of one blank at a time and at a predetermined rate, the apparatus according to the present invention includes a pivotal lever provided with at least one suction cup. The lever displaces one packaging container blank at a time from the discharge end of a magazine past a segmented wheel which grasps the discharged blank between a rubber cladding and a counter wheel for further advancement to a conveyor.

17 Claims, 2 Drawing Sheets

APPARATUS FOR DISCHARGING PACKAGING CONTAINER BLANKS

TECHNICAL FIELD OF THE INVENTION

The present invention relates to a packaging blank discharging apparatus, and more particularly to an apparatus for discharging one flat-laid packaging container blank at a time from a magazine.

BACKGROUND ART

Within that sector of the packaging industry which deals with the packing of different types of liquids, such as milk, in consumer packages or cartons of paper and plastic laminate, use is occasionally made of packaging machines which reform prefabricated packaging container blanks into bottom-sealed packaging containers which are thereafter immediately filled with the intended contents and then sealed. In such an instance, the packaging container blanks are fed to the machine in the form of stacks of flat-laid tubular blanks which, prior to reforming into individual packaging containers, must be discharged one-at-a-time from an outlet or discharge end of the magazine. After the discharge from the magazine, the blanks are conveyed further in order to be raised, i.e. reformed into substantially quadratic cross section, and are placed on mandrels for further transport through different treatment stations in a per se known packaging and filling machine, it is, thus, of major importance that the blanks are actually discharged one-at-a-time from the magazine, which, in practice, has proved to be the source of considerable difficulties since the flat-laid blanks may not only display varying thickness, but may also have a certain tendency to spring up into their quadratic cross sectional state.

One prior art apparatus for discharging packaging container blanks from a magazine is described in European Patent No. EP-A-241.916, to which reference is now made. In this prior art apparatus, use is made of a horizontal magazine in which a stack of packaging container blanks is placed. At the discharge end of the magazine, there is a substantially vertically disposed reciprocating plate which displays an abutment facing towards the magazine, the thickness of the abutment being slightly less than the thickness of one flat-laid packaging container blank. When the plate is located proximal its upper, extreme position, the blank passes a separation gap where only one blank at a time may pass. Above the separation gap, there are provided a number of fingers which prevent the blank from accompanying the plate back in its downward return stroke.

Like other prior art apparatuses of a similar type, the above-described prior art apparatus for discharging flat-laid packaging container blanks displays an acceptable level of function and operational reliability when handling blanks which correspond to specification tolerances in all respects. However, since certain variations in the thickness of the flat-laid blanks cannot be completely avoided, it happens from time to time that two blanks accompany the feeder plate simultaneously and are wedged in the separation gap, with operational disruption and unnecessary down time being the result. Variations in the thickness of the blanks may occasionally make it difficult to place the blanks in the correct position at the discharge end of the magazine, and so it also happens that the feeder plate passes the magazine without entraining a blank at all.

Another factor which gives rise to uncertainty in the discharge of blanks using prior art apparatuses is the friction between the individual blanks loaded in the magazine. One basic precondition for a blank to accompany the feeder plate is, of course, that the blank lies flat against the plate, and in order to ensure this, a relatively high pressure is applied against the opposite end of the row of packaging container blanks. As a result, the friction between the blanks will be extreme and the separation force increases, which may result in deformation of the blank when it is to be picked by the feeder plate.

Thus, there is a need in the art to provide a discharge apparatus which, with considerable reliability, can discharge one blank at a time irrespective of any possible variations in the quality or thickness of the blanks, or in the discharge force required from the magazine.

OBJECTS OF THE INVENTION

One object of the present invention is to devise a discharge apparatus which does not suffer from the above-outlined drawbacks, but which discharges, with great reliability, one blank at a time irrespective of friction differences between different blanks and irrespective of the urging force applied from rearwardly located blanks positioned in the magazine.

A further object of the present invention is to devise a discharge apparatus which, with full reliability, can grasp one blank at a time and release it from the magazine irrespective of whether the blank exactly corresponds to the established specification tolerances and guidelines and irrespective of whether the blank deviates in any way from such tolerances, for example if it displays minor deformations or discrepancies in thickness accuracy.

Yet a further object of the present invention is to devise an apparatus for discharging packaging container blanks, the apparatus being simple and reliable in design and construction and being suited for mass production at low cost.

SUMMARY OF THE INVENTION

These and other objects have been attained according to the present invention in that an apparatus for discharging one flat-laid packaging container blank at a time from a magazine includes a lever which is provided with a suction cup or suction cups and is pivotal between two positions, namely a first position in which the suction cup abuts against a blank located at a discharge end of the magazine, and a second position in which the active surface of the suction cup is located substantially in register with or slightly beneath a supply path which extends between the active surface of a segmented wheel and a counter wheel.

BRIEF DESCRIPTION OF THE ACCOMPANYING DRAWINGS

One preferred embodiment of the apparatus according to the present invention will now be described in greater detail hereinbelow, with particular reference to the accompanying schematic Drawings which show only those details essential to an understanding of the invention. In the accompanying Drawings:

FIG. 1 is a partial cross-sectional side elevation view of an apparatus according to the present invention; and FIG. 2 is a perspective view of a per se known packaging container blank of the type which the apparatus according to the invention is intended to handle.

DESCRIPTION OF PREFERRED EMBODIMENT

Figure 1:
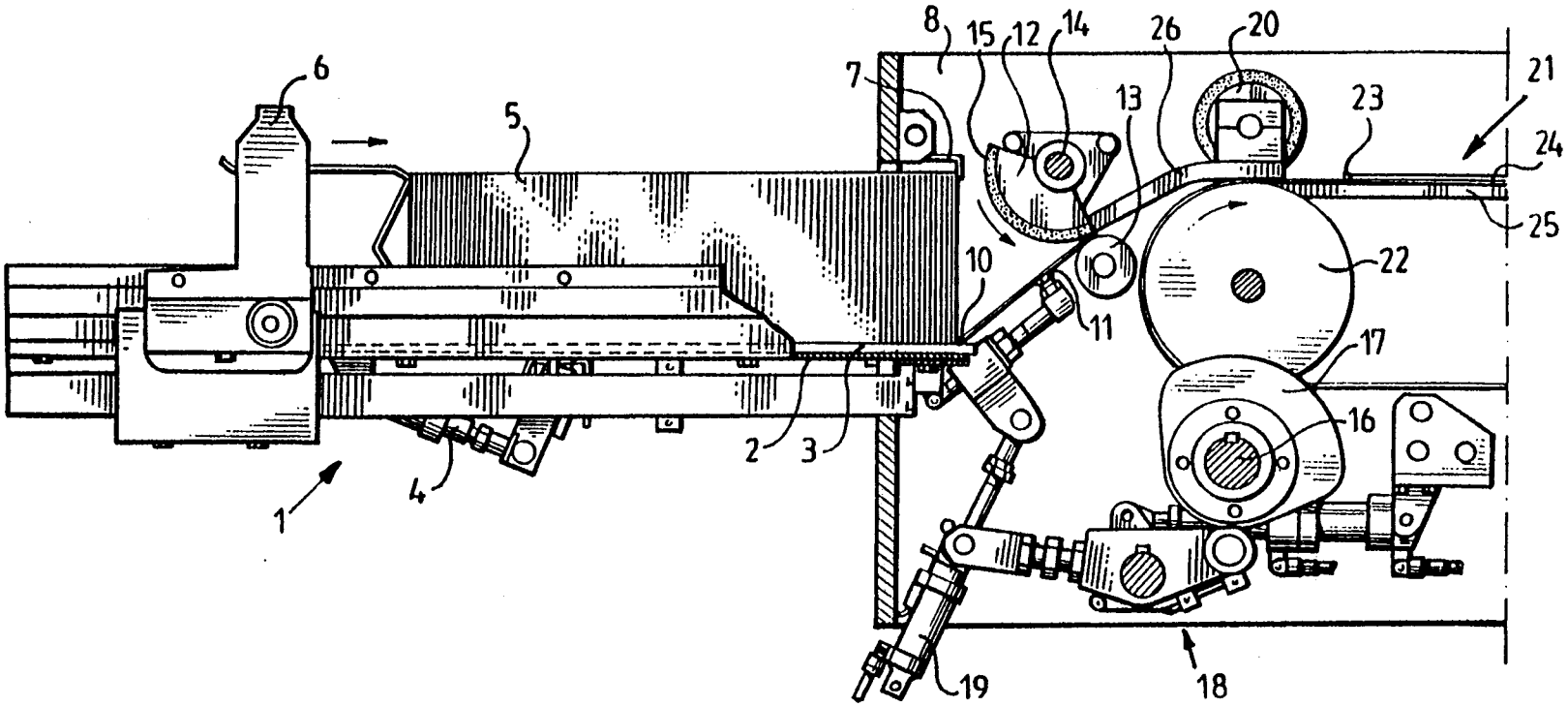

The apparatus according to the invention comprises a magazine 1 with a horizontally disposed oblong magazine floor 2. In the magazine floor, there are two parallel driving bands 3 which, by means of a driving cylinder 4, are displaceable in the forward direction of the magazine (to the right in FIG. 1) when they are located in an upper plane located outside the surface of the magazine floor 2, and to the left in FIG. 1 when they are located in a lower plane located beneath the surface of the magazine floor 2. This design and construction is known and thus will not be described in detail here.

On the magazine floor 2, there is disposed a row of flat-laid packaging container blanks 5. This row extends from a ram 6 displaceable along the longitudinal direction of the magazine to a number of catches 7 disposed at the outlet or discharge end of the magazine (to the right in FIG. 1). The catches prevent the leading blank 5 in the row from falling out of the magazine. The ram 6 is drivable along the magazine with the aid of a cylinder or equivalent drive means (not shown).

The discharge end of the magazine is connected to a frame 8 which carries the discharge apparatus proper. The discharge apparatus is intended to discharge one blank 5 at a time from the magazine I and advance this blank in the flat-laid state to a suitable position on a per se known packaging machine (not shown) where the blank is raised to substantially quadratic cross-section, is placed on a mandrel and conveyed further under progressive processing and reforming into a finished, filled package.

A lever 9 is journalled in the frame 8 at the discharge end of the magazine 1. The lever is pivotal about a pivot axis 10 which is oriented at right angles to the longitudinal direction of the magazine 1 and located flush with the magazine floor 2 immediately adjacent the outlet or discharge end of the magazine. The lever 9 is pivotal between two positions, i.e. a first position in which the lever extends substantially vertically, and a second position shown in FIG. 1 in which it extends at substantially 45° to the vertical plane. The lever 9 carries one or more suction cups 11 which, when the lever is located in its first position, are urged against a packaging container blank 5 retained by the catches 7 at the outlet end of the magazine. When the lever 9 is located in its second position illustrated in FIG. 1, the lever (or more precisely the active surface of the suction cup) is located substantially in register with or slightly (1–10 mm) beneath a supply path for the packaging container blanks which are located substantially in line with the magazine 1 a slight distance from its discharge end. The supply path extends between a segmented wheel 12 and a counter wheel 13. The segmented wheel 12 rotates in the counterclockwise direction on a shaft 14 which is parallel with the pivot axis 10 of the lever 9 and is provided with a rubber cladding 15 over approximately two-fifths of its circumference. The counter wheel 13 is freely rotatable but eccentrically suspended in order to make possible adjustment of the distance between the counter wheel 13 and the segmented wheel 12. The segmented wheel 12 is, like the lever 9, drivingly connected to a drive shaft 16 which displays a cam surface 17 which is connected to the lever 9 via a linkage assembly 18 and an overload cylinder 19. The drive shaft 16 and the segmented wheel 12 are mutually interconnected via a cogged belt (not shown) located on the rear side of the frame 8. A conveyor wheel 20 is also disposed along the above-mentioned supply path and is located above one end of a conveyor 21 for the blanks 5. The conveyor includes a conveyor wheel 22 disposed beneath the conveyor wheel 20 and around which runs a conveyor belt 24 provided with carriers 23. The conveyor wheel 22 and the conveyor 21 are driven by drive means (not shown) with the aid of the drive shaft 16. The conveyor belt runs on a support rail 25 which continues along the supply path of the blanks 5. In order to guarantee the transfer of the blanks from the segmented wheel 12 to the conveyor wheel 20, the apparatus also features a guide 26 for guiding the blanks in the correct position between the conveyor wheel 20 and the conveyor belt 24.

In addition to the above-described details, the apparatus according to the present invention also includes a number of per se known parts and devices for driving and adjusting the mutual positions of the included components, eg. air cylinders, regulator devices and other mechanisms which, however, are unlikely to need any in-depth description in this context.

Figure 2:
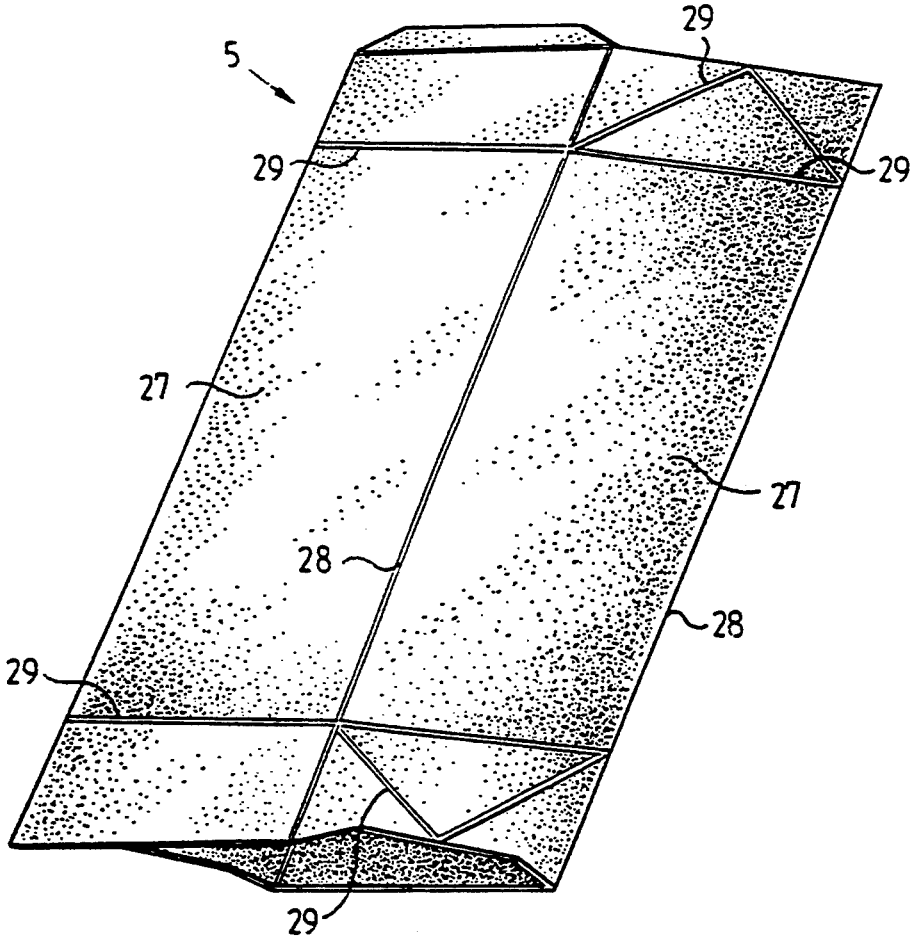

A packaging container blank 5 of the type which the apparatus according to the invention is intended to serve is shown in FIG. 2 in the flat-laid state. The blank comprises four side walls 27 which are separated by means of vertical crease lines 28. At the upper and lower end of the blank, respectively, there is a number of wall panels separated by further crease lines 29. These panels being intended to make possible folding and forming of the top and bottom of the packaging container. Hereby, the blank 5 may be reformed into a package of the so-called gable-top type, but it is self-evident that the apparatus according to the present invention may naturally also operate with other types of blanks intended for other types of packages. The blanks preferably consist of a flexible, semi rigid material, for example a packaging laminate comprising a core or carrier layer of fibrous material such as paper, which is coated on either face with a thermoplastic, liquid-tight material such as polyethylene.

When the apparatus according to the invention is in operation, the flat-laid packaging container blanks 5 are placed as shown in a row in the magazine 1. At this point, the packaging container blanks rest with their lowermost crease line 28 in this position against the magazine floor 2 and are displaced progressively forwards with the aid of the reciprocating driving bands 3. In order to ensure that the blanks 5 abut against one another and against the catches at the outlet or discharge end of the magazine with suitable abutment force, the ram 6 is urged against the rearmost of the packaging container blanks 5 located in the row. This will ensure that the row of blanks 5 is advanced towards the discharge end of the magazine with uniform force irrespective of friction differences and the number of blanks in the magazine.

At the outlet end of the magazine 1, the lever 9 is driven in its reciprocating movement between the first and second end positions with the aid of the drive shaft 16 and the linkage assembly 18. In order to ensure that any possible obstacles in the way of the movement of the lever 9 do not cause serious damage, the linkage assembly 18 includes, as has been mentioned above, the overload cylinder 19 which is an air cylinder provided with a transducer/emitter. When the movement of the lever 9, under normal operation, takes place without excessive resistance, the overload cylinder 19 serves as a fixed link. In the event of possible overload (i.e. when the lever 9 is blocked for one reason or another), the cylinder is compressed a few millimeters. This is sensed by the transducer which immediately ensures that the cylinder becomes depressurized so that the movement transmission of the drive shaft to the lever is discontinued.

When the lever 9 is located in its first, vertical position, the suction cup 11 will abut against the upper, free side wall 27 of the packaging container blank 5 located at the discharge end of the magazine 1. In this position, the suction cup is activated, which preferably takes place with the aid of a per se known valve governed by the pivotal position of the lever 9, the valve placing the suction cup in communication with a vacuum source (not shown). As soon as the suction cup 11 has grasped the blank 5, the lever 9 is pivoted back towards the second position (FIG. 1) located preferably somewhat beneath the supply path of the blank. In this instance, the blank 5 will, because of its flexibility, pass the catches 7 and thereby depart from the magazine 1 in which a following blank 5 is automatically advanced into abutment against the catches 7 with the aid of the ram 6 and the driving bands 3.

Since the active portion of the segmented wheel 12 extends into that region which is swept by the blank when the blank is displaced by means of the lever, the blank removed from the magazine by the lever 9 must, with its upper edge or crease line 28, pass the segmented wheel 12 while this is located in such position of rotation that its active portion is turned to face away from the magazine. As soon as the blank has reached the position shown in FIG. 1, the active portion of the segmented wheel 12 will, during its counterclockwise rotation, grasp the forward edge of the blank 5, seen in the direction of advancement, between the rubber cladding 15 and the counter wheel 13. In this position, the communication between the suction cup 11 and the vacuum source is severed and the blank may be freely displaced in between the segmented wheel 12 and the counter wheel 13. The length of the rubber cladding 15 of the segmented wheel is, as seen in the circumferential direction of the wheel, substantially the same as the distance between two of the opposing crease lines 28 of the blank 5. In such instance, the forward edge of the blank as seen in the direction of advancement will be guided with the aid of the guide 26 so that the blank, via the nip between the conveyor wheel 20 and the conveyor wheel 22, reaches the support rail 25 where the carriers 23 on the conveyor belt 24 grasp about the rear edge of the blank and displace the blank further. The driving of the conveyor belt 24 is synchronized with the movement of the segmented wheel 12, for which reason a transferred packaging container blank will automatically home into the correct position in order to be grasped by the carriers 23.

In practice, the apparatus according to the present invention has been formed to possess reliable, rapid operation which is not disrupted by variations between the different blanks or the abutment pressure between the blanks and the catches 7. Since the displacement of one blank from the magazine takes place without any appreciable deformation of the flat-laid blank, the risk that the blank come loose from the suction cup is reduced to a minimum.

The present invention should not be considered as restricted to that described above and shown on the Drawings, many modifications being conceivable without departing from the spirit and scope of the appended Claims.

What is claimed is:

1. A packaging container blank discharge apparatus for discharging, one at a time, flat-laid packaging container blanks, comprising a magazine which contains a plurality of flat-laid tubular packaging container blanks for being formed into packaging containers to hold contents, said magazine having a discharge end from which a forwardmost blank in the magazine is removed from the magazine, a pivotally mounted lever disposed adjacent the discharge end of the magazine, the lever being provided with at least one suction cup, and means for pivoting the lever between a first position in which the at least one suction cup abuts against the forwardmost blank located at the discharge end of the magazine and a second position in which an active surface of the at least one suction cup is located substantially in alignment with a supply path which extends between an active surface of a segmented wheel and a counter wheel.

2. The apparatus as claimed in claim 1, wherein the segmented wheel includes a shaft, the shaft of the segmented wheel being parallel with a pivot axis of the lever.

3. The apparatus as claimed in claim 1, wherein the active surface of the segmented wheel extends into a region which is swept by the blank during the displacement of the blank by the lever.

4. The apparatus as claimed claim 1, wherein the segmented wheel is rubber clad.

5. The apparatus as claimed in claim 1, wherein the means for pivoting the lever includes a drive shaft having a cam surface to which the lever is drivably connected, said drive shaft being synchronously rotated with the segmented wheel.

6. The apparatus as claimed claim 1, wherein a pivot axis of the lever is at right angles to a longitudinal direction of the magazine and is located flush with a floor of the magazine immediately adjacent the discharge end of the magazine.

7. A packaging container blank discharging apparatus for discharging, one at a time, individual flat-laid package blanks, comprising a magazine which contains a plurality of packaging container blanks that each have a plurality of side walls connect by fold lines for facilitating folding of the blanks into packaging containers for receiving contents, said magazine having a discharge end from which a forwardmost blank in the magazine is removed from the magazine, a pivotably movable lever having at least one suction cup mounted thereon for temporarily holding a package blank removed from a magazine, a rotatably driven wheel positioned in opposing relation to a counter wheel to advance a package blank along a path of movement that extends between the driven wheel and the counter wheel, and a driving device connected to the lever to pivot the lever between a first position in which the suction cup is located adjacent to the discharge end of the magazine to remove and hold a package blank located in the magazine, and a second position in which the package blank held by the suction cup is positioned adjacent the driven wheel and the counter wheel so as to be advanced along the path of movement.

8. Apparatus according to claim 7, wherein said counter wheel is mounted for free rotation and said driven wheel is a segmented wheel.

9. Apparatus according to claim 7, including first and second conveyor wheels positioned in opposing relation to one another and along the path of movement at a point downstream of the driven wheel and the counter wheel.

10. Apparatus according to claim 9, wherein the first conveyor wheel is positioned below the second conveyor wheel, and including a conveyor belt extending around the first conveyor wheel so that a package blank delivered by the lever passes between the conveyor belt and the second conveyor wheel.

11. Apparatus according to claim 10, wherein said conveyor belt is provided with carriers for gripping and advancing a package blank.

12. Apparatus according to claim 7, wherein the drive device includes a drive shaft to which the lever is connected, said drive shaft also being connected to the driven wheel, said drive shaft being connected to the lever by way of an overload cylinder which prevents transmission of a drive force to the lever from the drive shaft when movement of the lever experiences excessive resistance.

13. Apparatus according to claim 7, wherein the segmented wheel includes a contacting portion which contacts the blank when the lever reaches the second position, the contacting portion of the segmented wheel having a circumferential length that is substantially equal to the distance between two adjacent fold lines on the blank.

14. Apparatus according to claim 7, wherein the lever is pivotable about a pivot axis located flush with a floor of the magazine on which the blanks rest.

15. Apparatus according to claim 1, wherein said segmented wheel is positioned above said counter wheel.

16. Apparatus according to claim 1, including means for rotatably driving said segmented wheel, said segmented wheel including an active surface portion which contacts the blank to transport the blank along the supply path, and a remaining surface portion which remains out of contact with the blank during movement of the lever from the first portion to the second position.

17. Apparatus according to claim 1, wherein the active surface of the segmented wheel contacts the blank, advances the blank along the supply path, and has a radius that is larger than the radius of a remaining surface of the segmented wheel.

* * * * *